US007116203B2

(12) United States Patent
Nishikawa et al.

(10) Patent No.: US 7,116,203 B2
(45) Date of Patent: Oct. 3, 2006

(54) CIRCUIT USING CHOKE COIL AND CHOKE COIL

(75) Inventors: Yoshie Nishikawa, Fukui (JP); Kiyoteru Igashira, Takefu (JP); Takaaki Ooi, Takefu (JP); Tatsuyuki Yamada, Fukui-ken (JP); Hideki Kumatani, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 12 days.

(21) Appl. No.: 10/516,346

(22) PCT Filed: Nov. 28, 2003

(86) PCT No.: PCT/JP03/15209

§ 371 (c)(1),
(2), (4) Date: Nov. 30, 2004

(87) PCT Pub. No.: WO2004/061877

PCT Pub. Date: Jul. 22, 2004

(65) Prior Publication Data

US 2005/0174816 A1 Aug. 11, 2005

(30) Foreign Application Priority Data

Dec. 27, 2002 (JP) ..... 2002-380536

(51) Int. Cl.
*H01F 27/30* (2006.01)
*H01F 27/24* (2006.01)

(52) U.S. Cl. ..... 336/208; 336/212; 336/180; 333/181

(58) Field of Classification Search ..... 333/181; 336/198, 212, 208, 180, 182
See application file for complete search history.

(56) References Cited

U.S. PATENT DOCUMENTS 5,726,611 A * 3/1998 Takagi et al. ..... 333/181
5,825,259 A * 10/1998 Harpham ..... 333/22 R (Continued)

FOREIGN PATENT DOCUMENTS

JP 4-4712 1/1992

(Continued)

OTHER PUBLICATIONS

Official Communication issued in the corresponding Japanese Patent Application No. 2002-380536, dated Apr. 25, 2006.

*Primary Examiner*—Anh Mai
(74) *Attorney, Agent, or Firm*—Keating & Bennett, LLP

(57) ABSTRACT

A first winding of a choke coil is closely wound in a single layer on the outer periphery of a substantially cylindrical body portion of a first bobbin. A second winding is closely wound in a single layer over the first winding. A third winding is closely wound in a single layer on the outer periphery of a substantially cylindrical body portion of a second bobbin. A fourth winding is closely wound in a single layer over the third winding. The first, second, third and fourth windings are wound so as to mutually strengthen magnetic fluxes when an in-phase noise current flows. The first and second windings are connected to a pair of signal lines via which differential transmission communication is performed and on which a power supply current is sent out. The third and fourth windings are connected to a pair of signal lines via which differential transmission communication is performed and on which the power supply current returns. Thus, a circuit including a compact choke coil having large inductance and better high-frequency characteristics, and the choke coil is provided.

24 Claims, 7 Drawing Sheets

U.S. PATENT DOCUMENTS 5,831,505 A * 11/1998 Yamaguchi et al. ..... 336/83
6,900,717 B1 * 5/2005 Timashov et al. ..... 336/208

FOREIGN PATENT DOCUMENTS

JP 05-36821 U 5/1993
JP 10-261521 9/1998
JP 11-135330 5/1999
JP 2001-223117 8/2001
JP 2002-43148 A 2/2002

* cited by examiner

CIRCUIT USING CHOKE COIL AND CHOKE COIL

BACKGROUND OF THE INVENTION

1. Field of the Invention

The present invention relates to a circuit including a choke coil, and more particularly, to a circuit having a choke coil inserted into a signal line having communication and power-provision functions, and also relates to a choke coil.

2. Description of the Related Art

In the related art, differential transmission circuits are used for communication. In differential transmission, a twisted pair line carries signals having opposite phases, and the high/low level is determined based on which signal line has higher potential. For example, the current most common LAN standard for personal computers is Ethernet (registered trademark), and a pulse transformer is provided as an interface thereof. If high noise radiation is produced from a cable, common-mode choke coils are used before and after the pulse transformer.

One advantage of using a common-mode choke coil is that a restriction effect acts on common-mode noise without affecting the signals carried with opposite phases on the twisted pair line. In differential transmission, therefore, currents having the same magnitude flow with opposite phases in the twisted pair line, and the magnetic fluxes generated by the differential signal current are cancelled out in a magnetic core. On the other hand, the magnetic fluxes generated by a noise current flowing in-phase are mutually strengthened in a magnetic core.

In differential transmission communication, signals having a frequency of 100 MHz or higher may be used, and the signal frequency and the noise frequency band often overlap each other. A low-pass filter, such as a normal-mode choke coil, controls noise and signals at the same time, and is therefore difficult to use.

One known common-mode choke coil of the related art for preventing noise from entering a telephone line is described in Patent Document 1 (Japanese Unexamined Utility Model Registration Application Publication No. 4-4712). As shown in FIG. 9, a common-mode choke coil 1 includes a magnetic core having two U-shaped core members 10 and 11, two bobbins 2 and 3, and four windings 4, 5, 6, and 7.

The bobbins 2 and 3 have cylindrical body portions 2*a* and 3*a* arranged in parallel to each other. Leg portions 10*b* and 11*b* of the core members 10 and 11 are inserted through holes 2*b* and 3*b* in the cylindrical body portions 2*a* and 3*a*, respectively. The core members 10 and 11 form one closed magnetic path in which the leading ends of the leg portions 10*b* and 11*b* abut against each other in the holes 2*b* and 3*b*.

The windings 4 and 5 are bifilar-wound in one layer on the cylindrical body portion 2*a* of the bobbin 2. The windings 6 and 7 are also bifilar-wound in one layer on the cylindrical body portion 3*a* of the bobbin 3. The windings 4 to 7 are wound so as to mutually strengthen magnetic fluxes in the magnetic core when an in-phase current flows.

In the common-mode choke coil 1 having this structure, the number of winding portions in which the windings 4 and 5 or the windings 6 and 7 are adjacent is only two in the horizontal direction shown in FIG. 9, and the stray capacitances caused at the adjacent wound portions are connected in series a number of times corresponding to the number of turns. Thus, the stray capacitance can be reduced, and the ability to prevent noise from entering the high band can increase.

However, the common-mode choke coil 1 described in Patent Document 1 has a so-called bifilar-wound structure in which the windings 4 and 5 or the windings 6 and 7 are alternately wound in one layer on the cylindrical body portion 2*a* or 3*a* of the bobbin 2 or 3. Thus, there is a problem in that the number of turns of the windings 4 to 7 per unit length is small, resulting in small inductance obtained compared to the size of the bobbins 2 and 3. A high-precision winding machine is required to produce such a bifilar-wound structure. However, product failure still occurs due to disordered winding. Disordered winding greatly affects the high-frequency characteristics of the product.

Recently, a standard called IEEE 802.3af has been proposed by the Institute of Electrical and Electronic Engineers. This standard defines a circuit having a power-provision circuit in a traditional differential transmission circuit, and also defines power provision via a signal line, such as a LAN cable for transmitting and receiving signals. This standard is applied to devices, such as IP phones connected to LAN cables and wireless LAN access points. When a common-mode choke coil is used for noise prevention on a signal line to be defined by this standard, the magnetic fluxes generated by a power supply current are generated in the direction in which they are strengthened in a magnetic core of the common-mode choke coil. Due to the magnetic fluxes generated by the power supply current, the magnetic flux density of the magnetic core becomes close to a saturated magnetic flux density, and the common-mode choke coil inductance is reduced. The noise prevention effect is therefore reduced. One approach for preventing an increase in the magnetic flux density is to increase the cross-sectional area of the magnetic core. However, as the size of the magnetic core increases, the product size also increases. Moreover, the cost of the magnetic core occupies the majority of the product material cost. Thus, an increase in the size of the magnetic core greatly affects the product price. If the number of turns of windings is small, small magnetic fluxes are generated in the magnetic core, and the core is less saturated. However, the inductance becomes small, and the noise prevention effect is therefore reduced.

SUMMARY OF THE INVENTION

In order to overcome the problems described above, preferred embodiments of the present invention provide a circuit including a compact choke coil having large inductance, and a choke coil. More specifically, preferred embodiments of the present invention provide a compact choke coil having large inductance and better high-frequency characteristics that can be inserted in a signal line circuit complying with IEEE 802.3af.

A circuit including a choke coil according to a preferred embodiment of the present invention includes:

(a) first and second signal lines via which differential transmission communication is performed and on which a power supply current is sent out;

(b) third and fourth signal lines via which differential transmission communication is performed and on which the power supply current returns; and (c) a choke coil having first, second, third, and fourth windings, and a magnetic core constituting a closed magnetic path in which the first, second, third, and fourth windings are wound; wherein (d) the first, second, third, and fourth windings are electrically connected to the first, second, third, and fourth signal lines, respectively; and (e) the first winding and the second winding are wound in the same direction so that magnetic fluxes generated in the magnetic core are mutually strengthened when an in-phase noise current flows, the third winding and the fourth winding are wound in the same direction so that magnetic fluxes generated in the magnetic core are mutually strengthened when an in-phase noise current flows, and the first and second windings and the third and fourth windings are wound so that magnetic fluxes generated in the magnetic core are mutually strengthened when an in-phase noise current flows.

With this unique structure, a signal line circuit having communication and power-provision functions, more specifically, a circuit including a choke coil that is suitable for a signal line circuit complying with IEEE 802.3af, can be achieved.

A choke coil according to a preferred embodiment of the present invention is a choke coil that is inserted in a signal line having communication and power-provision functions, including:

(f) first and second bobbins each having a substantially cylindrical body portion;

(g) a first winding that is closely wound in a single layer on the substantially cylindrical body portion of the first bobbin and a second winding that is closely wound in a single layer over the first winding;

(h) a third winding that is closely wound in a single layer on the substantially cylindrical body portion of the second bobbin and a fourth winding that is closely wound in a single layer over the third winding; and (i) a magnetic core having leg portions that are inserted through holes in the substantially cylindrical body portions of the first and second bobbins to constitute a closed magnetic path; wherein (j) the first winding and the second winding are wound in the same direction so that magnetic fluxes generated in the magnetic core are mutually strengthened when an in-phase noise current flows, the third winding and the fourth winding are wound in the same direction so that magnetic fluxes generated in the magnetic core are mutually strengthened when an in-phase noise current flows, and the first and second windings and the third and fourth windings are wound so that magnetic fluxes generated in the magnetic core are mutually strengthened when an in-phase noise current flows. An insulating resin member, a magnetic-powder-containing insulating resin member, a ferrite member having a surface that is coated with insulating resin, a metal member having a surface that is coated with insulating resin, or a metal member may be disposed between the first bobbin and the second bobbin.

With this unique structure, the first to fourth windings are closely wound in a single layer, and the number of turns per unit length increases. Thus, large inductance can be obtained even if the substantially cylindrical body portions of the bobbins are short. The number of wound portions in which the first and second windings or the third and fourth windings are adjacent is only one in the vertical direction shown in FIG. 2. Although the stray capacitances caused at the adjacent wound portion are connected in parallel only at the wound portion, the stray capacitances are small.

In the choke coil according to a preferred embodiment of the present invention, each of the first bobbin and the second bobbin includes flange portions at both ends of the substantially cylindrical body portion, and the outer peripheries of the flange portions of the first bobbin are brought into contact with or engaged with the outer peripheries of the flange portions of the second bobbin. Thus, the mechanical stress applied to one of the bobbins is distributed to the other bobbin, and the rigidity of the overall product increases. A change in inductance due to the mechanical stress is also minimized.

Other features, elements, steps, characteristics and advantages of the present invention will become more apparent from the following detailed description of preferred embodiments with reference to the attached drawings.

DETAILED DESCRIPTION OF PREFERRED EMBODIMENTS

A circuit using a choke coil and the choke coil according to various preferred embodiments of the present invention will be described with reference to the accompanying drawings.

Figure 1:
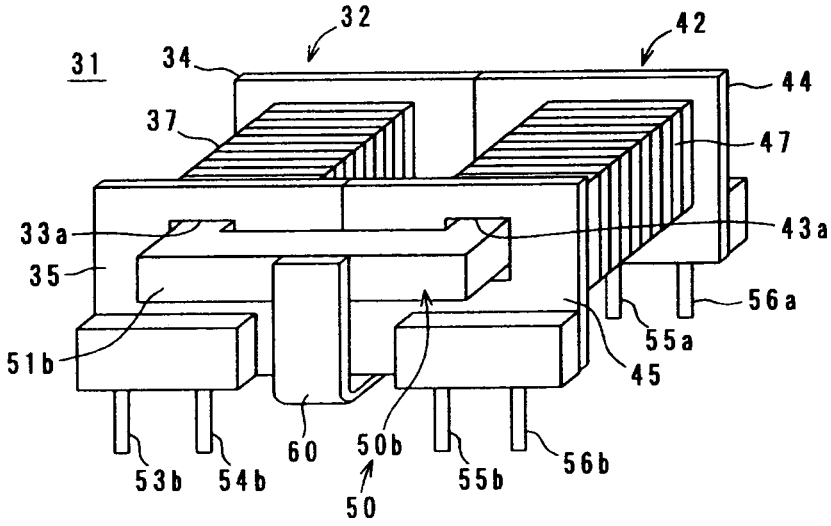
FIG. 1 is an external perspective view of a choke coil according to a preferred embodiment of the present invention.
Figure 2:
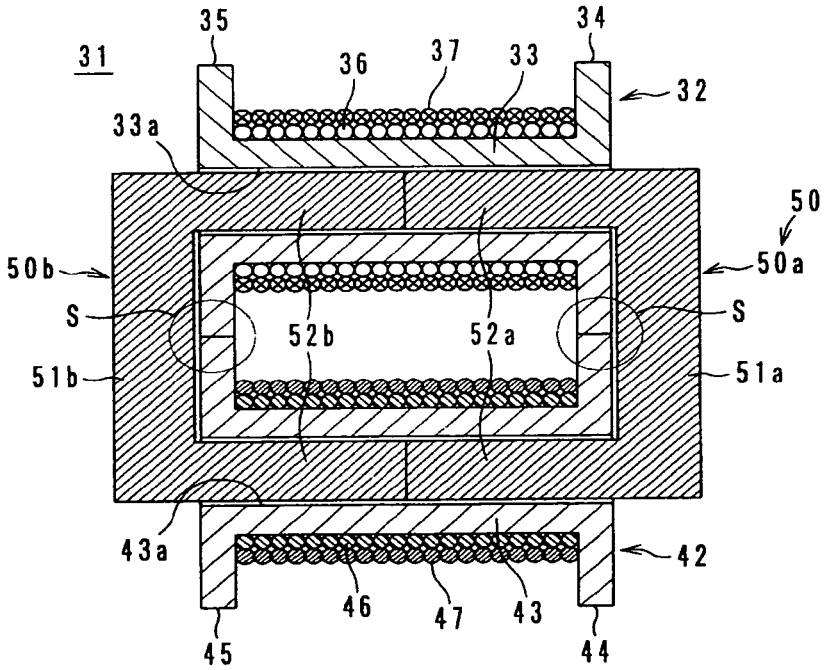
FIG. 2 is a horizontal cross-sectional view of the choke coil shown in FIG. 1.
Figure 3:
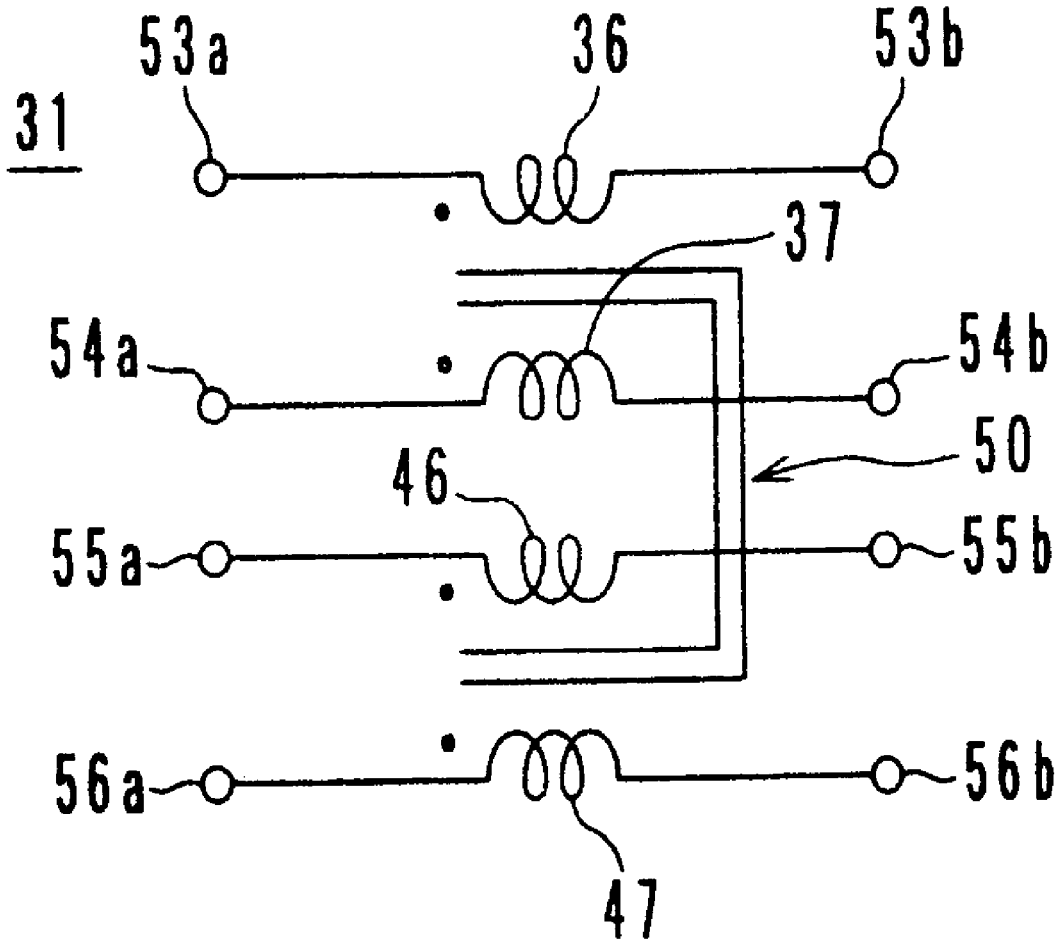
FIG. 3 is an electrically equivalent circuit diagram of the choke coil shown in FIG. 1.

FIG. 1 is an external view of a common-mode choke coil, FIG. 2 is a horizontal cross-sectional view of the choke coil, and FIG. 3 is an electrical equivalent circuit diagram of the choke coil. A common-mode choke coil 31 preferably includes a magnetic core 50 having two substantially U-shaped core members 50*a* and 50*b*, two bobbins 32 and 42, four windings 36, 37, 46, and 47, and a fitting plate 60.

The bobbins 32 and 42 include substantially cylindrical body portions 33 and 43, and flange portions 34 and 35, and 44 and 45 at both ends of the substantially cylindrical body portions 33 and 43, respectively. The flange portions 34, 35, 44, and 45 have pairs of lead terminals 53*a* and 54*a*, 53*b* and 54*b*, 55*a* and 56*a*, and 55*b* and 56*b*, i.e., eight terminals. The bobbins 32 and 42 are arranged so that the substantially cylindrical body portions 33 and 43 are substantially parallel to each other. The bobbins 32 and 42 are preferably made of resin or other suitable material.

The winding 36 is closely wound in a single layer on the outer periphery of the substantially cylindrical body portion 33 of the bobbin 32. The winding 37 is closely wound in a single layer over the winding 36. The windings 36 and 37 are wound by the same number of turns in the same direction so as to mutually strengthen magnetic fluxes when an in-phase noise current flows. The winding 46 is also closely wound in a single layer on the outer periphery of the substantially cylindrical body portion 43 of the bobbin 42. The winding 47 is closely wound in a single layer over the winding 46. The windings 46 and 47 are wound by the same number of turns in the same direction so as to mutually strengthen magnetic fluxes when an in-phase noise current flows. The windings 36 and 37 and the windings 46 and 47 are wound by the same number of turns so as to mutually strengthen magnetic fluxes when an in-phase noise current flows.

Both ends of the winding 36 are electrically connected with the lead terminals 53*a* and 53*b* of the bobbin 32, and both ends of the winding 37 are electrically connected with the lead terminals 54*a* and 54*b*. Both ends of the winding 46 are electrically connected with the lead terminals 55*a* and 55*b* of the bobbin 42, and both ends of the winding 47 are electrically connected with the lead terminals 56*a* and 56*b*.

The core members 50*a* and 50*b* of the magnetic core 50 include arm portions 51*a* and 51*b*, and leg portions 52*a* and 52*b* extending substantially perpendicularly from both ends of the arm portions 51*a* and 51*b*, respectively. The leg portions 52*a* and 52*b* of the core members 50*a* and 50*b* are inserted in holes 33*a* and 43*a* in the substantially cylindrical body portions 33 and 43 of the bobbins 32 and 42. The core members 50*a* and 50*b* define one closed magnetic path in which the leading ends of the leg portions 52*a* and 52*b* abut against each other in the holes 33*a* and 43*a*.

The core members 50*a* and 50*b* are preferably made of Mn—Zn or Ni—Zn ferrite, or both. Mn—Zn ferrite has high magnetic permeability, and can therefore have larger inductance (several ten mH to several hundred mH) than Ni—Zn ferrite. An inductance of several ten mH to several hundred mH is required for suppressing a noise voltage from the low-frequency band (several kHz). Ni—Zn ferrite has a better frequency characteristic of the magnetic permeability, and can therefore exhibit a larger inductance characteristic at a higher frequency (several ten MHz to several hundred MHz) than Mn—Zn ferrite. Both Mn—Zn ferrite and Ni—Zn ferrite may be used to have large inductance at a wide frequency band.

The fitting plate 60 having a substantially rectangular U-shaped configuration is engaged for robustly bringing the abutting surfaces of the core members 50*a* and 50*b* into close contact. The core members 50*a* and 50*b* may robustly be brought into close contact using adhesive instead of the fitting plate 60. The elements 32, 42, 50*a*, 50*b*, and 60 are fixed by a fixing tool (not shown), or fixed by applying a minimum amount of adhesive or varnish (not shown) between the bobbins 32 and 42 and the core members 50*a* and 50*b*.

The common-mode choke coil 31 having this structure has a large number of turns per unit length because each of the windings 36, 37, 46, and 47 is closely wound in a single layer. Thus, large inductance can be obtained even if the substantially cylindrical body portions 33 and 43 of the bobbins 32 and 42 are short. The number of wound portions in which the windings 36 and 37 or the windings 46 and 47 are adjacent is only one in the vertical direction shown in FIG. 2. Thus, the stray capacitance caused at the adjacent wound portion is small. Therefore, a four-terminal common-mode choke coil having better noise elimination at the high-frequency band can be realized.

In IEEE 802.3af, it is necessary to eliminate noise from the low frequency region to the high frequency region, and the component that forms the communication signal waveform overlaps the frequency band that requires noise prevention. Thus, large inductance, low leakage inductance, and high-frequency characteristics are demanded for the common-mode choke coil 31. If noise terminal voltage restrictions for the low-frequency region (30 MHz or lower) are applied to a communication line, the common-mode choke coil 31 is suitable for noise elimination from the low frequency region to the high frequency region, and has effects of removing both a noise terminal voltage in the low frequency region (30 MHz or lower) and radiation noise in the high frequency region (30 MHz or higher). The common-mode choke coil 31 is therefore suitable for the IEEE 802.3af standard.

A common-mode choke having a structure in which the wound area is divided by a divider plate disposed on a substantially cylindrical body portion of a bobbin and windings are wound in different wound areas, which is referred to as a division-type common-mode choke coil, provides a large leakage magnetic flux. Therefore, this common-mode choke is not suitable for the IEEE 802.3af standard, which requires small leakage inductance.

Figure 4:
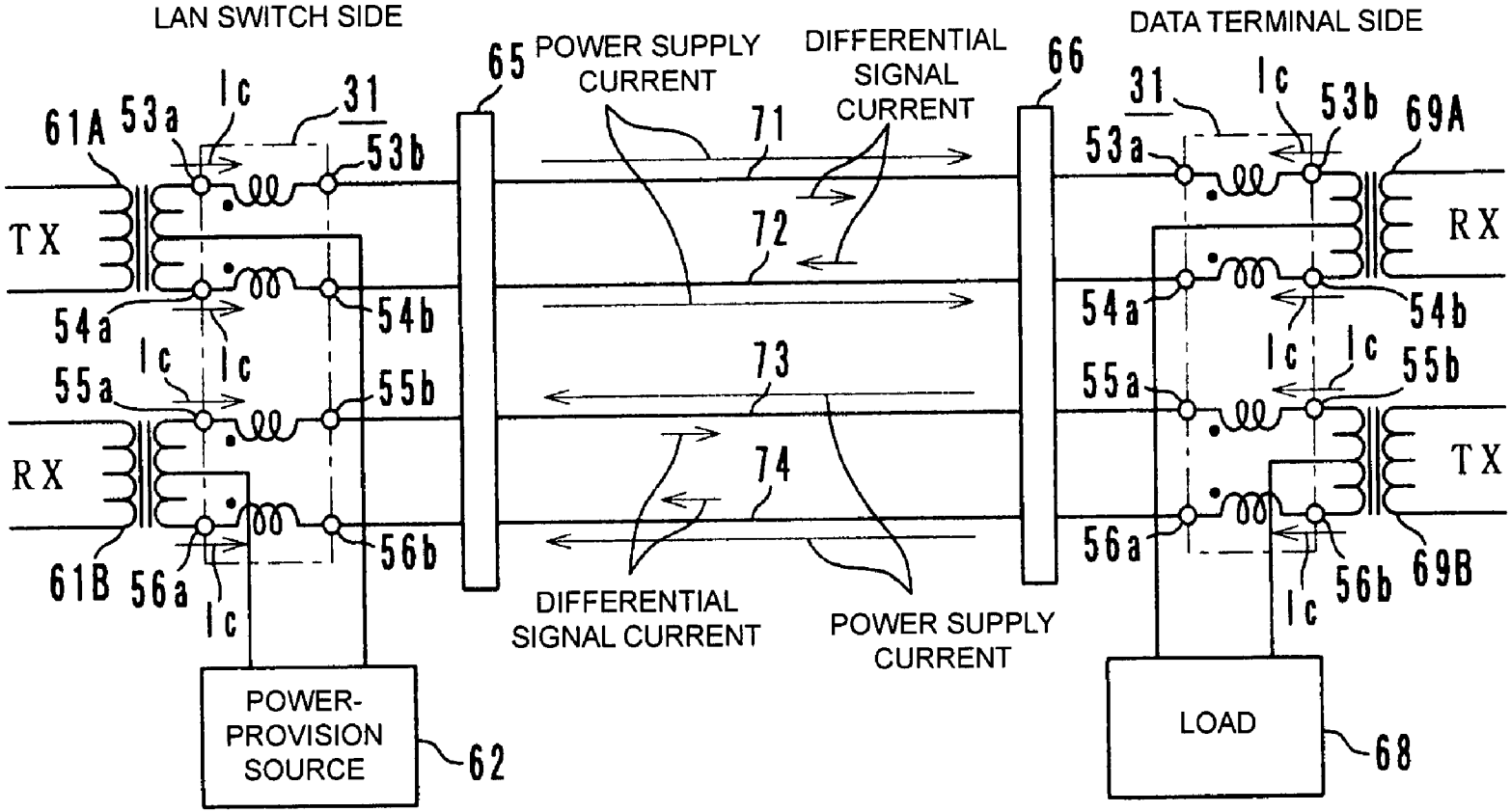
FIG. 4 is a circuit diagram of a circuit in which the choke coil shown in FIG. 1 is connected to a signal line complying with IEEE 802.3af.

FIG. 4 shows a circuit in which the common-mode choke coil 31 is connected to signal lines 71 to 74 complying with IEEE 802.3af for the purpose of performing both communication and power-provision functions. The signal lines 71 to 74 are implemented by, for example, LAN cables for transmitting and receiving signals, which carry a power supply current. In FIG. 4, reference numerals 61A and 61B denote LAN-switch-side pulse transformers, reference numeral 62 denotes a power-provision source, reference numerals 65 and 66 denote connectors (for example, RJ-45 connectors), reference numeral 68 denotes a load, and reference numerals 69A and 69B denote data-terminal-side pulse transformers.

Figure 5:
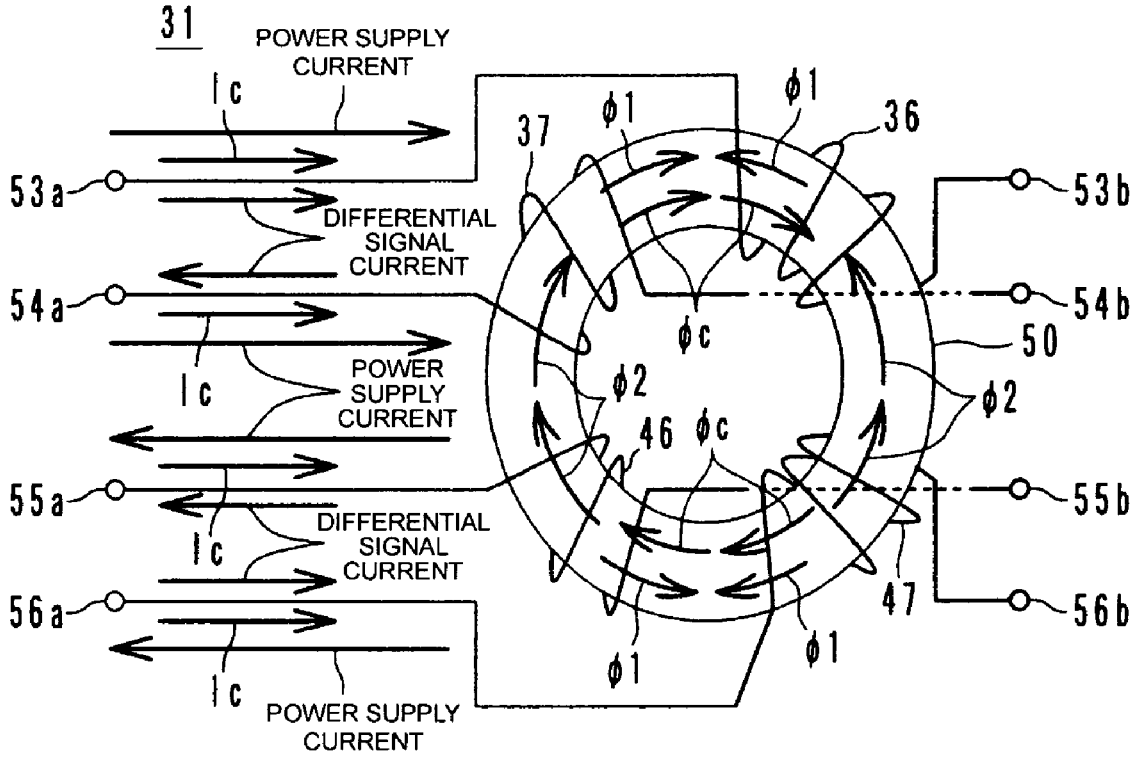
FIG. 5 is a schematic diagram for describing the effects and advantages of the choke coil shown in FIG. 4.
Figure 6A:
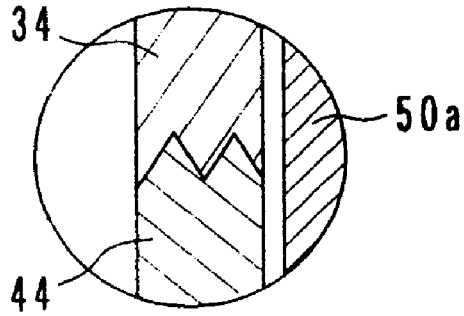
FIGS. 6(A) to 6(D) are partially enlarged cross-sectional views showing engagement of the outer peripheries of flange portions of bobbins.
Figure 6B:
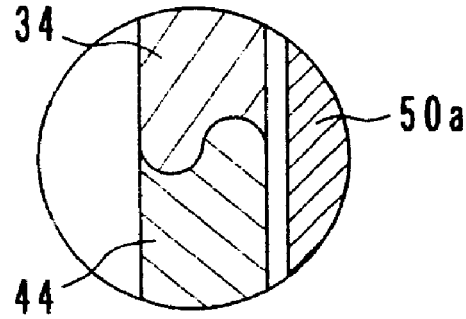
Figure 6C:
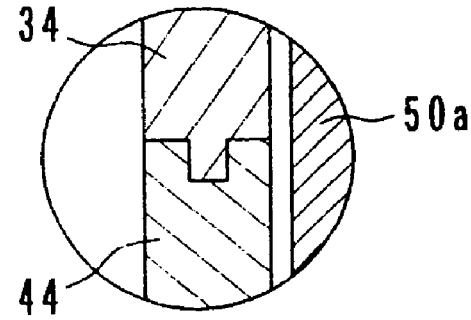
Figure 6D:
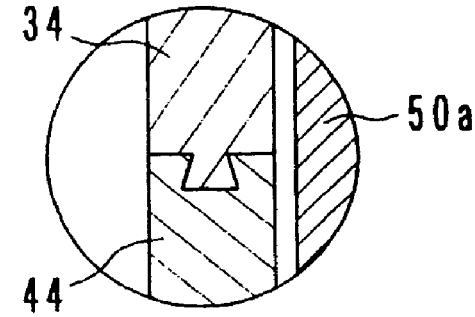

The effects and advantages of the common-mode choke coil 31 will now be described with reference to a schematic diagram shown in FIG. 5. In differential transmission communication, same-magnitude differential signal currents having opposite phases flow in two pairs of windings 36 and 37, and 46 and 47. A magnetic flux $\phi 1$ that is generated in the magnetic core 50 by flowing a signal current in the winding 36 of the pair of windings 36 and 37, and a magnetic flux $\phi 1$ that is generated in the magnetic core 50 by flowing a signal current in the other winding 37 are generated with the same magnitude in opposite directions. Thus, the magnetic fluxes $\phi 1$ and $\phi 1$ are cancelled out. The same applies to the pair of windings 46 and 47.

The phenomenon that magnetic fluxes are cancelled out occurs independently in the pair of windings 36 and 37 and the pair of windings 46 and 47. Therefore, if two different differential signal currents are carried by the two pairs of windings 36 and 37, and 46 and 47 at the same time, the interference due to magnetic coupling does not occur in the magnetic core 50.

A combination (parallel connection) of the windings 36 and 37 is used as a line on which the power supply current is sent out, and a combination (parallel connection) of the windings 46 and 47 is used as a line on which the power supply current returns. In this case, a sum of the power supply currents applied to the windings 36 and 37 and a sum of the power supply currents applied to the windings 46 and 47 are the same in magnitude and opposite in phase. Thus, a magnetic flux $\phi 2$ that is generated in the magnetic core 50 via the windings 36 and 37 and a magnetic flux $\phi 2$ that is generated in the magnetic core 50 via the windings 46 and 47 are cancelled out. Therefore, the magnetic core 50 is not magnetically saturated. In the magnetic core 50 that is small, the inductance can increase as the number of turns of the windings 36, 37, 46, and 47 increases.

Accordingly, the functionality of the common-mode choke coil can be sufficiently achieved. The combination of the windings 36 and 37 and the combination of the windings 46 and 47 allow a large tolerant current to flow in the lines.

In the common-mode choke coil 31, when a common-mode (in-phase) noise current Ic flows in the windings 36, 37, 46, and 47, magnetic fluxes ϕc are generated in the same direction in the magnetic core 50 via the windings 36, 37, 46, and 47. The magnetic fluxes ϕc turn in the magnetic core 50 while they are mutually strengthened. Therefore, the impedance becomes large with respect to the common-mode noise current Ic, and the common-mode noise current Ic is minimized. It is presumed that the common-mode noise current Ic is about several mA at the peak and the power supply current is about several hundred mA.

As indicated by circle portions S shown in FIG. 2, in this preferred embodiment, the outer peripheries of the flange portions 34 and 35 of the bobbins 32 are brought into contact with the outer peripheries of the flange portions 44 and 45 of the bobbin 42. Thus, the mechanical stress applied to one of the bobbins is distributed to the other bobbin, and the rigidity of the overall common-mode choke coil 31 increases. The mechanical stress is not locally applied to the magnetic core 50, and there is no fear that the abutting surfaces of the core members 50*a* and 50*b* will be out of position or a gap will occur. Therefore, the effective magnetic permeability of the magnetic core 50 is not prone to change, and a stable inductance characteristic can be obtained. By changing the sizes of the flange portions 34, 35, 44, and 45, the distance between the windings 36 and 37 and the windings 46 and 47 can be adjusted, and the electromagnetic interference and the insulating characteristic can be adjusted.

In this case, not only are the outer peripheries of the flange portions 34 and 35 and the outer peripheries of the flange portions 44 and 45 contacted but the flange portions 34 and 35 and the flange portions 44 and 45 are also engaged with each other, as shown in, for example, FIGS. 6(A) to 6(D), which is more effective.

Generally, common-mode choke coils have a slight normal-mode leakage inductance component, and have a further advantage of removing normal-mode noise. However, if common-mode noise and strong normal-mode noise are caused to flow in a signal (power supply) line, common-mode choke coil parts and normal-mode choke coil parts must be used to take noise measurements. In a common-mode choke coil having a relatively large normal-mode leakage inductance component, the leakage magnetic flux can affect a peripheral circuit. In this case, a magnetic shield is required to be placed over the outer circumference of the common-mode choke coil.

Figure 7:
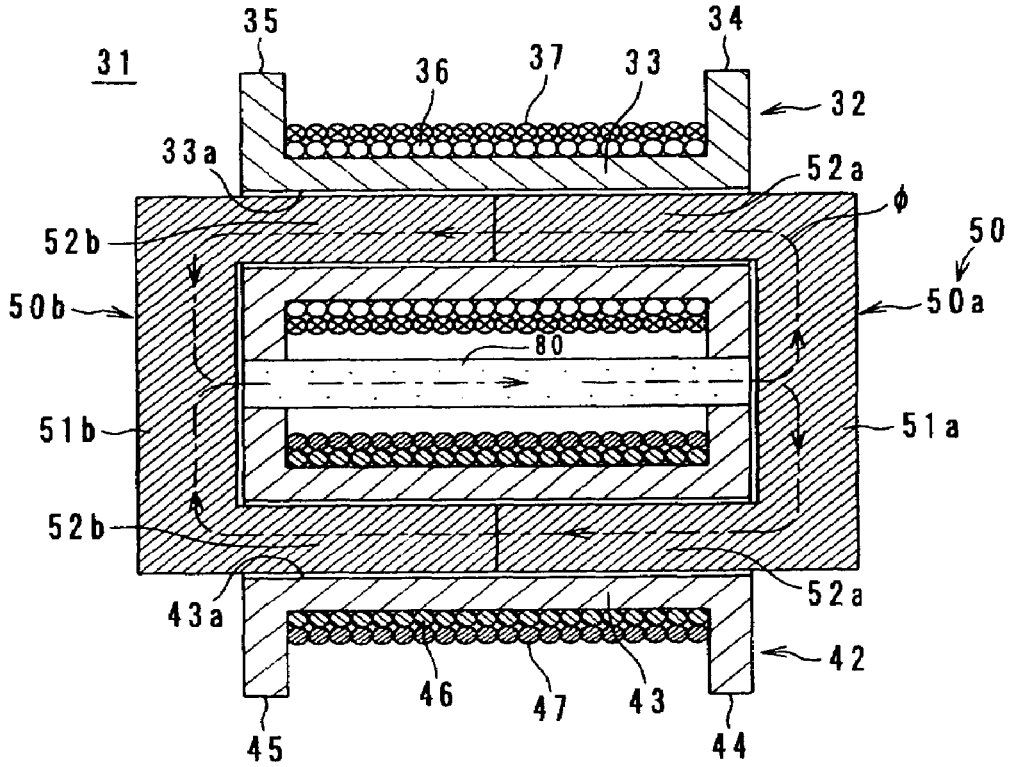
FIG. 7 is a horizontal cross-sectional view of a choke coil according to another preferred embodiment of the present invention.

Accordingly, as shown in FIG. 7, a magnetic-powder-containing insulating resin member 80 having a relative magnetic permeability of about 1 or higher (e.g., about 2 to about several tens) is placed between the two adjacent bobbins 32 and 42 of the common-mode choke coil 31. The magnetic-powder-containing insulating resin member 80 is brought into contact with or is engaged with the outer peripheries of the flange portions 34, 35, 44, and 45 of the bobbins 32 and 42. The magnetic-powder-containing insulating resin member 80 is preferably made by kneading Ni—Zn ferrite of, for example, about 80 wt % to about 90 wt % and nylon or polyphenylene sulfide resin.

The magnetic-powder-containing insulating resin member 80 is easily processed and has an insulating property. Thus, no insulating spacer is required between the core members 50*a* and 50*b*.

The magnetic-powder-containing insulating resin member 80 increases the effective magnetic permeability of a normal-mode magnetic path, and magnetic fluxes ϕ are concentrated in the magnetic path having high effective magnetic permeability (the magnetic-powder-containing insulating resin member 80 and the core members 50*a* and 50*b*). Thus, the common-mode choke coil 31 having a large normal-mode inductance component and capable of also eliminating strong normal-mode noise can be achieved, and any adverse effect of the leakage magnetic flux on a peripheral circuit can be minimized.

The value of the normal-mode inductance component depends upon the contact area of the core members 50*a* and 50*b* and the magnetic-powder-containing insulating resin member 80, the gap therebetween, the relative magnetic permeability of the magnetic-powder-containing insulating resin member 80, etc. In the common-mode choke coil 31, as the normal-mode inductance component increases, the core members 50*a* and 50*b* are readily saturated. The extent to which the normal-mode inductance component can increase depends upon the characteristics (the saturation characteristic, the relative magnetic permeability, etc.) of the used core members 50*a* and 50*b* and the current flowing in the common-mode choke coil 31. That is, it is necessary to increase the normal-mode inductance component within a prescribed operating range of the common-mode choke coil 31 using the magnetic-powder-containing insulating resin member 80 so that the core members 50*a* and 50*b* are not saturated.

The magnetic-powder-containing insulating resin member 80 between the two bobbins 32 and 42 can extend the distance of insulation between the windings 37 and 47, and can effectively utilize the space of the common-mode choke coil 31 to reduce the size.

In place of the magnetic-powder-containing insulating resin member 80, a ferrite member having a surface that is coated with insulating resin may be used. This ferrite member (preferably made of Mn—Zn or Ni—Zn ferrite) also achieves similar effects and advantages to those of the magnetic-powder-containing insulating resin member 80.

Alternatively, an insulating resin member may be used instead of the magnetic-powder-containing insulating resin member 80. The distance between the windings 36 and 37 and the windings 46 and 47 can be adjusted depending upon the thickness of the insulating resin member, and the electromagnetic interference and the insulating characteristic can efficiently be improved.

Figure 8:
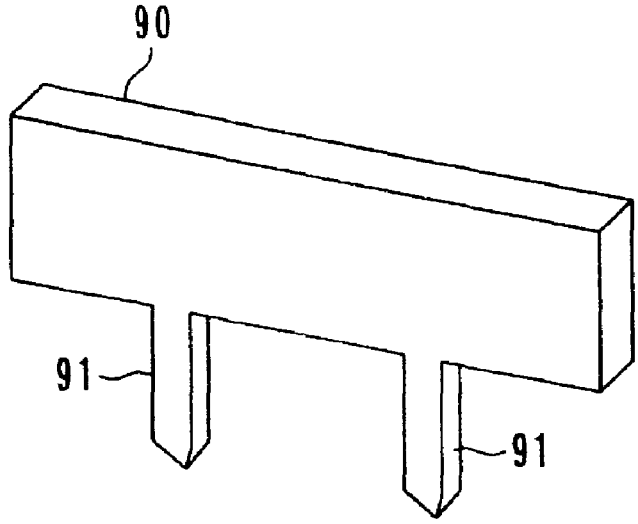
FIG. 8 is a perspective view of a metal member placed between the bobbins.
Figure 9:
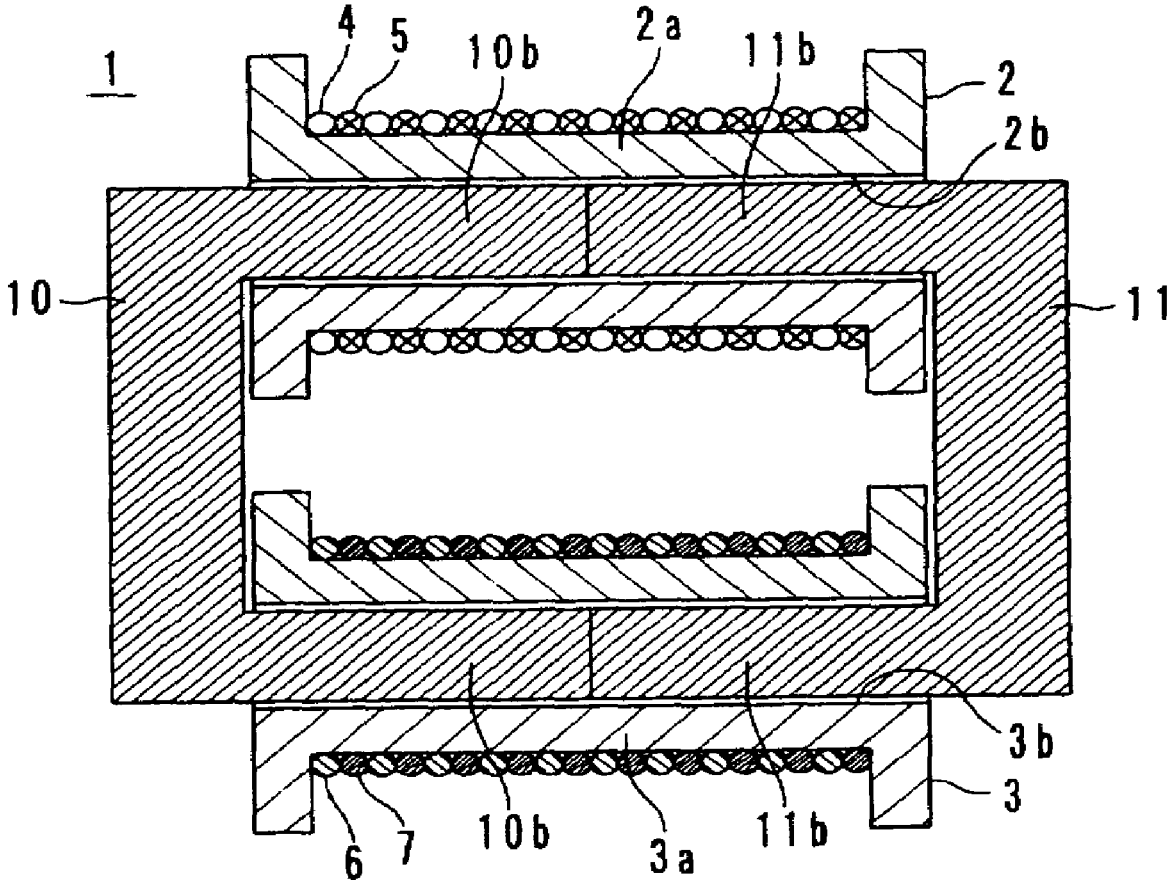
FIG. 9 Prior Art
FIG. 9 is a horizontal cross-sectional view of a choke coil of the related art.

In place of the magnetic-powder-containing insulating resin member 80, a metal member 90 shown in FIG. 8 may be used. The metal member 90 has ground lead terminals 91, and the ground lead terminals 91 are soldered to a ground pattern of a printed circuit board. Thus, the metal member 90 functions as an electromagnetic shield for suppressing the electromagnetic interference between the windings 36 and 37 and the windings 46 and 47. A surface of the metal member 90 may be coated with insulating resin to increase the insulating characteristic.

The present invention is not limited the illustrated preferred embodiments, and a variety of modifications may be made without departing from the scope of the invention. For example, a square-shaped integrated core or a double-square-shaped integrated core may be used as a magnetic core, and a bobbin having a gear divided into two or more pieces may be used as a bobbin.

According to preferred embodiments of the present invention, therefore, a circuit including a compact choke coil having large inductance can be realized. The choke coil of preferred embodiments of the present invention has a large number of turns per unit length because first to fourth windings are closely wound in a single layer. Thus, large inductance can be obtained even if a bobbin has a short substantially cylindrical body portion. Moreover, the stray capacitance caused at a wound portion in which the first and second windings or the third and fourth windings are adjacent is small. Therefore, a compact choke coil having large inductance and better high-frequency characteristics that can be inserted in a signal line circuit complying with IEEE 802.3af can be provided.

It should be understood that the foregoing description is only illustrative of the present invention. Various alternatives and modifications can be devised by those skilled in the art without departing from the present invention. Accordingly, the present invention is intended to embrace all such alternatives, modifications, and variations that fall within the scope of the appended claims.

The invention claimed is:

1. A circuit including a choke coil, comprising:

first and second signal lines via which differential transmission communication is performed and on which a power supply current is sent out;

third and fourth signal lines via which differential transmission communication is performed and on which the power supply current returns; and a choke coil having first, second, third, and fourth windings, and a magnetic core constituting a closed magnetic path in which the first, second, third, and fourth windings are wound; wherein the first, second, third, and fourth windings are electrically connected to the first, second, third, and fourth signal lines, respectively;

the first winding and the second winding are wound in the same direction so that magnetic fluxes generated in the magnetic core are mutually strengthened when an in-phase noise current flows, and the third winding and the fourth winding are wound in the same direction so that magnetic fluxes generated in the magnetic core are mutually strengthened when an in-phase noise current flows; and the first and second windings and the third and fourth windings are wound so that magnetic fluxes generated in the magnetic core are mutually strengthened when an in-phase noise current flows.

2. The circuit according to claim 1, wherein each of the first bobbin and the second bobbin includes flange portions at both ends of the substantially cylindrical body portion thereof, and outer peripheries of the flange portions of the first bobbin contact with or are engaged with outer peripheries of the flange portions of the second bobbin.

3. The circuit according to claim 1, wherein one of an insulating resin member, a magnetic-powder-containing insulating resin member, a ferrite member having a surface that is coated with insulating resin, a metal member having a surface that is coated with insulating resin, and a metal member is placed between the first bobbin and the second bobbin.

4. The circuit according to claim 1, wherein the magnetic core includes two substantially U-shaped core members.

5. The circuit according to claim 1, further comprising two bobbins including substantially cylindrical body portions and flange portions at both ends of the substantially cylindrical body portions.

6. The circuit according to claim 5, wherein the flange portions include pairs of lead terminals connected to a respective one of the first, second, third and fourth windings, and the bobbins are arranged so that the substantially cylindrical body portions are substantially parallel to each other.

7. The circuit according to claim 1, wherein the first and second windings are wound by the same number of turns in the same direction so as to mutually strengthen magnetic fluxes when an in-phase noise current flows.

8. The circuit according to claim 1, wherein the third and fourth windings are wound by the same number of turns in the same direction so as to mutually strengthen magnetic fluxes when an in-phase noise current flows.

9. The circuit according to claim 1, wherein the first and second windings, and the third and fourth windings, are wound by the same number of turns so as to mutually strengthen magnetic fluxes when an in-phase noise current flows.

10. The circuit according to claim 1, further comprising two bobbins including substantially cylindrical body portions having holes provided therein, wherein the magnetic core includes two substantially U-shaped core members, the core members include arm portions and leg portions extending substantially perpendicularly from both ends of the arm portions, and the leg portions are inserted in the holes in the substantially cylindrical body portions of the bobbins.

11. The circuit according to claim 10, wherein the core members define one closed magnetic path in which leading ends of the leg portions abut against each other in the holes.

12. The circuit according to claim 11, further comprising a fitting plate having a substantially rectangular U-shaped configuration and arranged to bring abutting surfaces of the core members into close contact with each other.

13. The circuit according to claim 1, wherein the choke coil operates according to the IEEE 802.3af standard.

14. A choke coil that is inserted in a signal line having communication and power-provision functions, comprising:

first and second bobbins each having a substantially cylindrical body portion;

a first winding that is closely wound in a single layer on the substantially cylindrical body portion of the first bobbin and a second winding that is closely wound in a single layer over the first winding;

a third winding that is closely wound in a single layer on the substantially cylindrical body portion of the second bobbin and a fourth winding that is closely wound in a single layer over the third winding; and a magnetic core having leg portions that are inserted through holes in the substantially cylindrical body portions of the first and second bobbins to define a closed magnetic path; wherein the first winding and the second winding are wound in the same direction so that magnetic fluxes generated in the magnetic core are mutually strengthened when an in-phase noise current flows;

the third winding and the fourth winding are wound in the same direction so that magnetic fluxes generated in the magnetic core are mutually strengthened when an in-phase noise current flows; and the first and second windings and the third and fourth windings are wound so that magnetic fluxes generated in the magnetic core are mutually strengthened when an in-phase noise current flows.

15. The choke coil according to claim 14, wherein each of the first bobbin and the second bobbin includes flange portions at both ends of the substantially cylindrical body portion thereof, and outer peripheries of the flange portions of the first bobbin contact with or are engaged with outer peripheries of the flange portions of the second bobbin.

16. The choke coil according to claim 14, wherein one of an insulating resin member, a magnetic-powder-containing insulating resin member, a ferrite member having a surface that is coated with insulating resin, a metal member having a surface that is coated with insulating resin, and a metal member is placed between the first bobbin and the second bobbin.

17. The choke coil according to claim 14, wherein the magnetic core includes two substantially U-shaped core members.

18. The choke coil according to claim 14, wherein the first and second bobbins include flange portions at both ends of the substantially cylindrical body portions and the flange portions include pairs of lead terminals connected to a respective one of the first, second, third and fourth windings, and the first and second bobbins are arranged so that the substantially cylindrical body portions are substantially parallel to each other.

19. The choke coil according to claim 14, wherein the first and second windings are wound by the same number of turns in the same direction so as to mutually strengthen magnetic fluxes when an in-phase noise current flows.

20. The choke coil according to claim 14, wherein the third and fourth windings are wound by the same number of turns in the same direction so as to mutually strengthen magnetic fluxes when an in-phase noise current flows.

21. The choke coil according to claim 14, wherein the first and second windings, and the third and fourth windings, are wound by the same number of turns so as to mutually strengthen magnetic fluxes when an in-phase noise current flows.

22. The choke coil according to claim 14, wherein the substantially cylindrical body portions of the first and second bobbins have holes provided therein, the magnetic core includes two substantially U-shaped core members, the core members include arm portions and the leg portions extend substantially perpendicularly from both ends of the arm portions, and the leg portions are inserted in the holes in the substantially cylindrical body portions of the bobbins.

23. The choke coil according to claim 22, further comprising a fitting plate having a substantially rectangular U-shaped configuration and arranged to bring abutting surfaces of the core members into close contact with each other.

24. The choke coil according to claim 14, wherein the choke coil operates according to the IEEE 802.3af standard.

* * * * *